US011723463B2

(12) United States Patent
Pizzi et al.

(10) Patent No.: US 11,723,463 B2
(45) Date of Patent: Aug. 15, 2023

(54) REFRIGERATOR CABINET

(71) Applicant: True Manufacturing Co., Inc., O'Fallon, MO (US)

(72) Inventors: Christian Pizzi, St. Peters, MO (US); Daniel Pestka, Wentzville, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 30 days.

(21) Appl. No.: 17/480,827

(22) Filed: Sep. 21, 2021

(65) Prior Publication Data

US 2023/0087769 A1 Mar. 23, 2023

(51) Int. Cl.

| | |
|---|---|
| ***A47B 91/02*** | (2006.01) |
| ***A47B 91/06*** | (2006.01) |
| ***A47F 3/04*** | (2006.01) |

(52) U.S. Cl.

CPC ..... *A47B 91/022* (2013.01); *A47B 91/06* (2013.01); *A47F 3/0439* (2013.01)

(58) Field of Classification Search

CPC combination set(s) only.
See application file for complete search history.

(56) References Cited

U.S. PATENT DOCUMENTS 2,725,667 A * 12/1955 Ingarra ..... A47B 91/024 248/188.4
3,868,079 A * 2/1975 Johnson ..... A47B 91/024 248/188.4
4,991,805 A * 2/1991 Solak ..... F25D 23/00 248/188.4
5,086,627 A 2/1992 Borgen
5,332,182 A * 7/1994 Weisz ..... G01G 23/002 248/188.4

(Continued)

FOREIGN PATENT DOCUMENTS

EP 1633218 A1 3/2006
JP 2003139466 A 5/2003

(Continued)

OTHER PUBLICATIONS

Zero Zone Hybrid Display Cases, retrieved from https://www.zero-zone.com/hybrid-display-cases/, on Sep. 14, 2021, 4 pages.

(Continued)

*Primary Examiner* — Monica E Millner
(74) *Attorney, Agent, or Firm* — Stinson LLP

(57) ABSTRACT

A foot is connected to the bottom wall of a refrigeration cabinet. The foot is selectively movable relative to the bottom wall to adjust a vertical position of the foot with respect to the bottom wall. The bottom wall provides access to the foot from within the interior of the cabinet to allow a user to selectively move the foot to adjust the vertical position of the foot with respect to the bottom wall. The foot includes a stop configured to engage the bottom wall and thereby limit downward adjustment of the foot with respect to the bottom wall. A floor glide is connected to the bottom wall and initially protrudes downward from the bottom wall beyond the foot. The floor glide enables the cabinet to slide along a support surface to a deployment position so then the foot can be lowered to support the cabinet at the deployment position on the foot.

14 Claims, 17 Drawing Sheets

(56) References Cited

U.S. PATENT DOCUMENTS

| | | | | |
|---|---|---|---|---|
| 5,967,472 | A * | 10/1999 | Wilhelmstatter | A47B 91/028 248/188.4 |
| 5,971,350 | A | 10/1999 | McCutcheon | |
| 7,744,050 | B2 * | 6/2010 | de Toledo | F16M 7/00 248/650 |
| 8,485,480 | B2 * | 7/2013 | Bove | A47B 91/024 248/188.4 |
| 9,074,809 | B2 | 7/2015 | Lee et al. | |
| 9,417,001 | B2 | 8/2016 | Grewal et al. | |
| 9,528,736 | B2 | 12/2016 | Grewal et al. | |
| 9,532,660 | B2 | 1/2017 | Jafa et al. | |
| 10,054,350 | B2 | 8/2018 | Grewal et al. | |
| 10,119,742 | B2 | 11/2018 | Grewal et al. | |
| 10,194,757 | B2 * | 2/2019 | Resch | F25D 23/00 |
| 10,288,358 | B2 | 5/2019 | Goseling | |
| 10,420,426 | B2 | 9/2019 | Resch | |
| 10,427,701 | B1 | 10/2019 | Brede | |
| 11,300,347 | B1 * | 4/2022 | Pizzi | F25D 23/065 |
| 2008/0116330 | A1 * | 5/2008 | Cotto | A47B 91/024 248/188.4 |
| 2009/0184614 | A1 | 7/2009 | Walsberg | |
| 2011/0187247 | A1 | 8/2011 | Carter | |
| 2014/0203698 | A1 * | 7/2014 | Kim | F25D 23/028 312/405 |
| 2017/0172317 | A1 | 6/2017 | Hay | |
| 2018/0049548 | A1 | 2/2018 | Lercher | |
| 2018/0271276 | A1 | 9/2018 | Chartrand et al. | |
| 2018/0347822 | A1 * | 12/2018 | Jang | F24C 15/083 |
| 2019/0293322 | A1 | 9/2019 | Ullah | |
| 2020/0008575 | A1 | 1/2020 | Cole | |
| 2020/0109508 | A1 | 4/2020 | Oh et al. | |

FOREIGN PATENT DOCUMENTS

| | | | |
|---|---|---|---|
| JP | 2004037008 | A | 2/2004 |
| JP | 3572866 | B2 | 10/2004 |
| KR | 20050112428 | A | 11/2005 |

OTHER PUBLICATIONS

Freedom Line, retrieved from https://www.hussmann.com/freedom-lin, on Sep. 14, 2021, 3 pages.

Ocet Catering Line, retrieved from https://eu.tecoonline.eu/wp-content/uploads/2021/02/OCET-line.pdf, on Sep. 14, 2021, 27 pages.

Zero Zone Highlight Merchandiser RHZC30 Hybrid Specs, retrieved from https://www.zero-zone.com/includes/loadFile.php?GID=11c8cc6a9ac6a3316de5475284d6f0de, on Sep. 14, 2021, 2 pages.

True Manufacturing Company et al. : "Spec Series—STR, STA & STG", Sep. 11, 2020, XP55878254, Retrieved from the Internet: URL: https://www.youtube.com/watch?v=Ogai_fLoDlo.

Invitation to Pay Additional Fees, and Where Applicable, Protest Fee, International Application No. PCT/US2021/051785 dated Jan. 26, 2022, 54 pages.

International Search Report and Written Opinion, International Application No. PCT/US2021/051497, dated Mar. 11, 2022, 22 pages.

* cited by examiner

REFRIGERATOR CABINET

FIELD

The present disclosure pertains generally to refrigerator cabinets, and more particularly to refrigerator cabinets with features for moving and/or leveling the cabinet onsite.

BACKGROUND

Commercial refrigerator cabinets are widely used to refrigerate large quantities of goods such as food or medicine. For example, refrigerated merchandiser cabinets are used to hold refrigerated food for sale. Many end users require the cabinet to be installed level for properly storing the refrigerated goods. Typically, the cabinet is placed on shim stacks, which facilitate leveling the unit.

SUMMARY

In one aspect a refrigeration cabinet comprises walls separating an exterior of the cabinet from an interior of the cabinet that is configured to be refrigerated by a refrigeration system connected to the cabinet. The walls include a bottom wall. A foot is connected to the bottom wall for supporting the bottom wall on a support surface. The foot is selectively movable relative to the bottom wall to adjust a vertical position of the foot with respect to the bottom wall. The bottom wall is configured such that the foot is accessible from within the interior of the cabinet to allow a user to selectively move the foot to adjust the vertical position of the foot with respect to the bottom wall.

In another aspect, a method of deploying a refrigeration cabinet comprises positioning the refrigeration cabinet at a deployment location such that the refrigeration cabinet is supported on a support surface. At least one of a plurality of feet connected to a bottom wall of the refrigeration cabinet is moved relative to the bottom wall to adjust a vertical position of the bottom wall relative to the support surface. Said moving at least one of a plurality of feet comprises accessing said at least one of a plurality of feet within an interior of the refrigeration cabinet.

In another aspect, a refrigeration cabinet comprises walls separating an exterior of the cabinet from an interior of the cabinet that is configured to be refrigerated by a refrigeration system connected to the cabinet. The walls include a bottom wall. At least one foot is connected to the bottom wall and protrudes downward from the bottom wall a first distance. The foot being movable relative to the bottom wall along a vertical axis. A floor glide is connected to the bottom wall and protrudes downward from the bottom wall a second distance greater than the first distance. The floor glide is configured to enable the cabinet to slide along a support surface to a deployment position and the foot is configured to be lowered after the cabinet is at the deployment position to support the cabinet at the deployment position on the foot.

In another aspect, a refrigeration cabinet comprises walls separating an exterior of the cabinet from an interior of the cabinet that is configured to be refrigerated by a refrigeration system connected to the cabinet. The walls include a bottom wall. A foot is connected to the bottom wall for supporting the bottom wall on a support surface. The foot is selectively movable relative to the bottom wall to adjust a vertical position of the foot with respect to the bottom wall. A driver is configured to automatically drive movement of the foot. A level sensor is configured to output a signal representative of a level orientation of the cabinet. A controller is configured to receive the signal from the level sensor and to actuate the driver based on the signal to move the foot to level the cabinet.

In another aspect, a refrigeration cabinet comprises walls separating an exterior of the cabinet from an interior of the cabinet that is configured to be refrigerated by a refrigeration system connected to the cabinet. The walls include a bottom wall. A foot is connected to the bottom wall for supporting the bottom wall on a support surface. The foot is selectively movable relative to the bottom wall to adjust a vertical position of the foot with respect to the bottom wall. The bottom wall is configured such that the foot is accessible from within the interior of the cabinet to allow a user to selectively move the foot to adjust the vertical position of the foot with respect to the bottom wall. The foot includes a stop configured to limit downward adjustment of the foot with respect to the bottom wall of the cabinet.

In another aspect, a support assembly for a refrigerated cabinet comprises a support bracket including at least one threaded opening and an adjustable foot for each of the at least one threaded opening. Each adjustable foot includes a threaded shaft threadably received in the threaded opening. The threaded shaft has an upper end portion and a lower end portion spaced apart along an axis of the threaded shaft. The upper end portion of the threaded shaft includes a peripheral annular groove. Each adjustable foot further includes a retaining ring received in the peripheral annular groove. The retaining ring is sized and arranged to engage an upper portion of the support bracket when the adjustable foot is threadably advanced downward to a bottom position of the adjustable foot, whereby the retaining ring forms a stop that limits downward movement of the adjustable foot with respect to the support bracket.

Other aspects will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
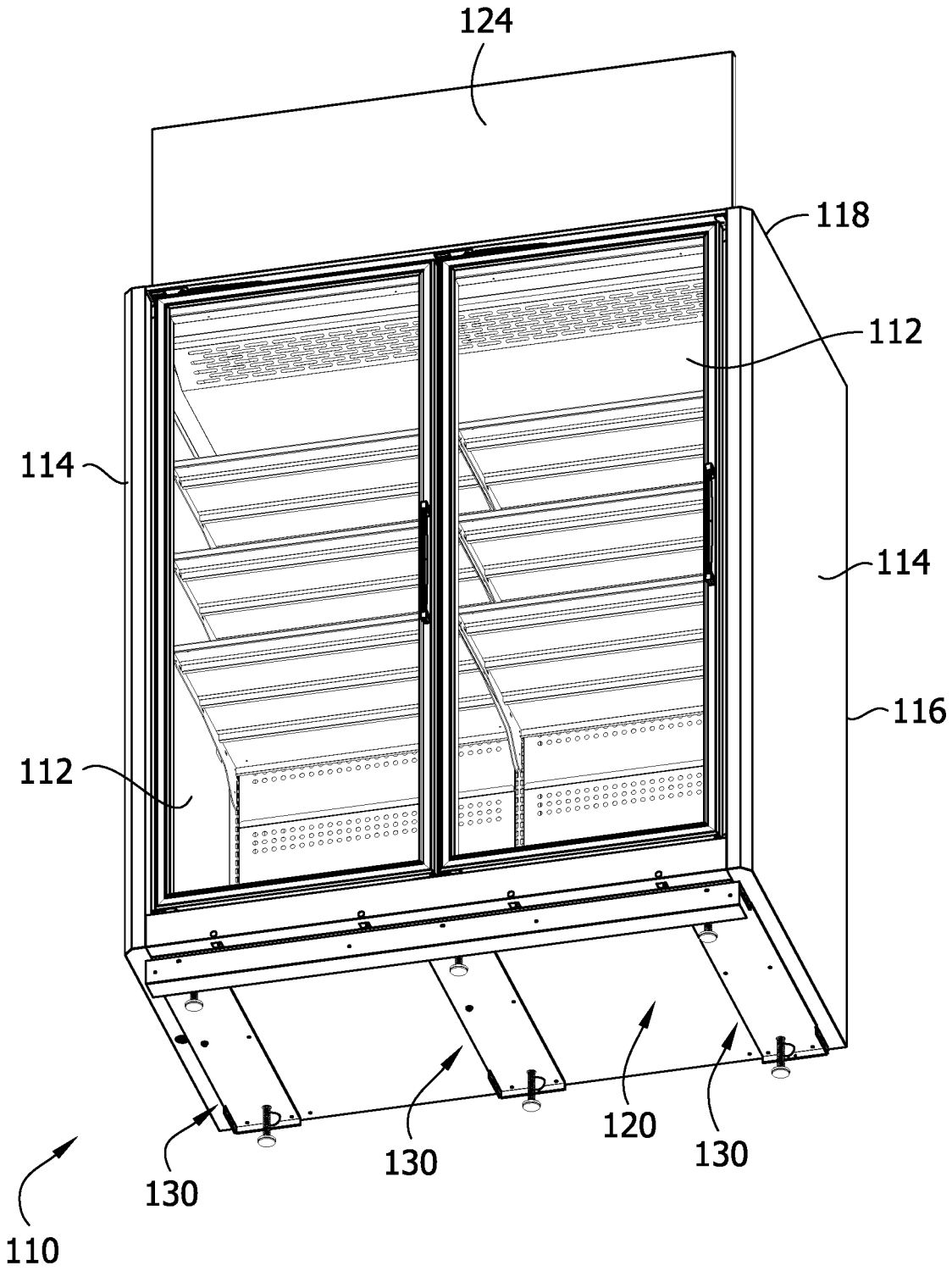
FIG. 1 is a perspective of a refrigerated merchandiser cabinet.
Figure 2:
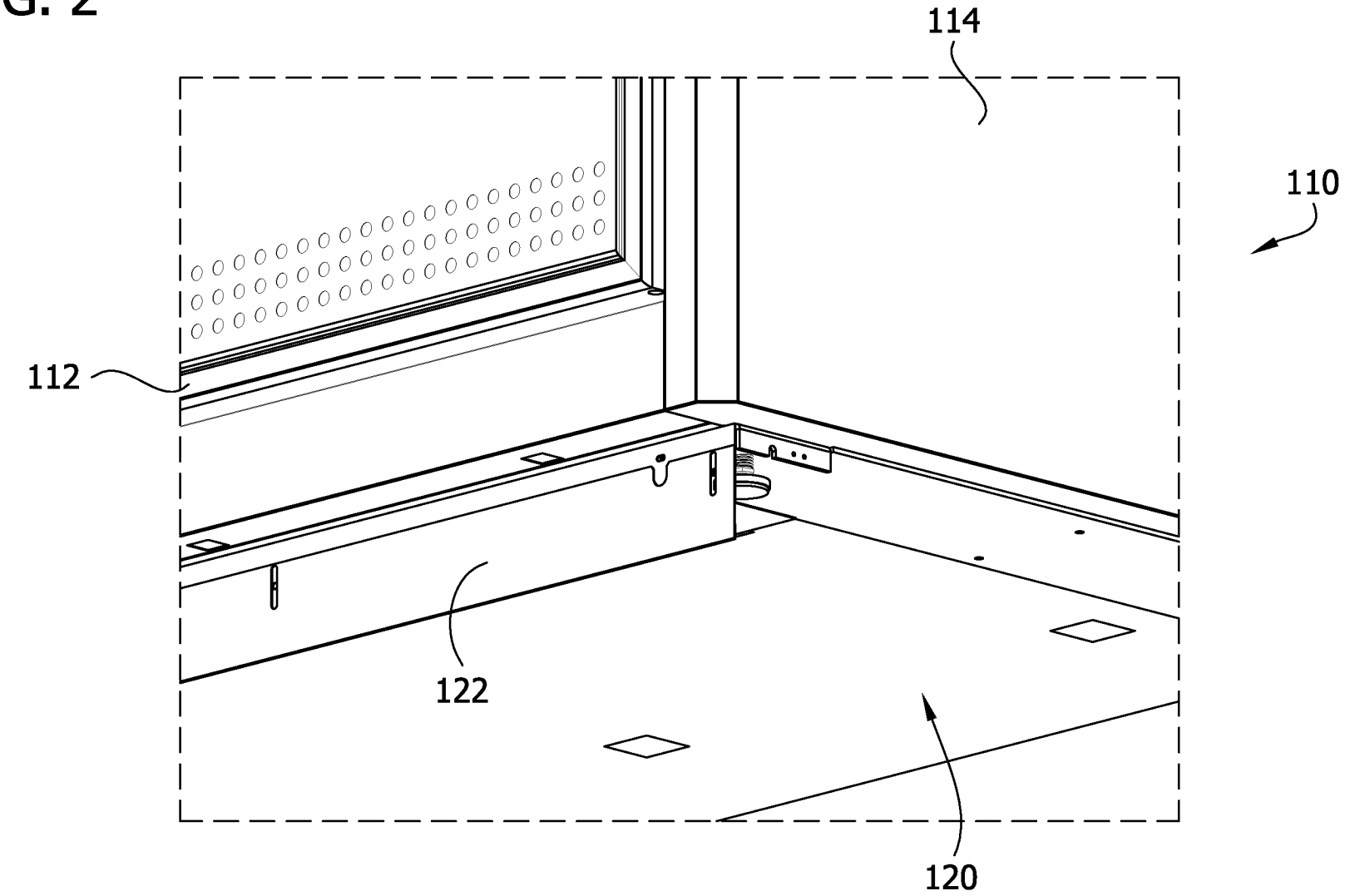
FIG. 2 is an enlarged fragmentary perspective of a portion of the cabinet showing a toe kick connected to a bottom wall via a support assembly.
Figure 3:
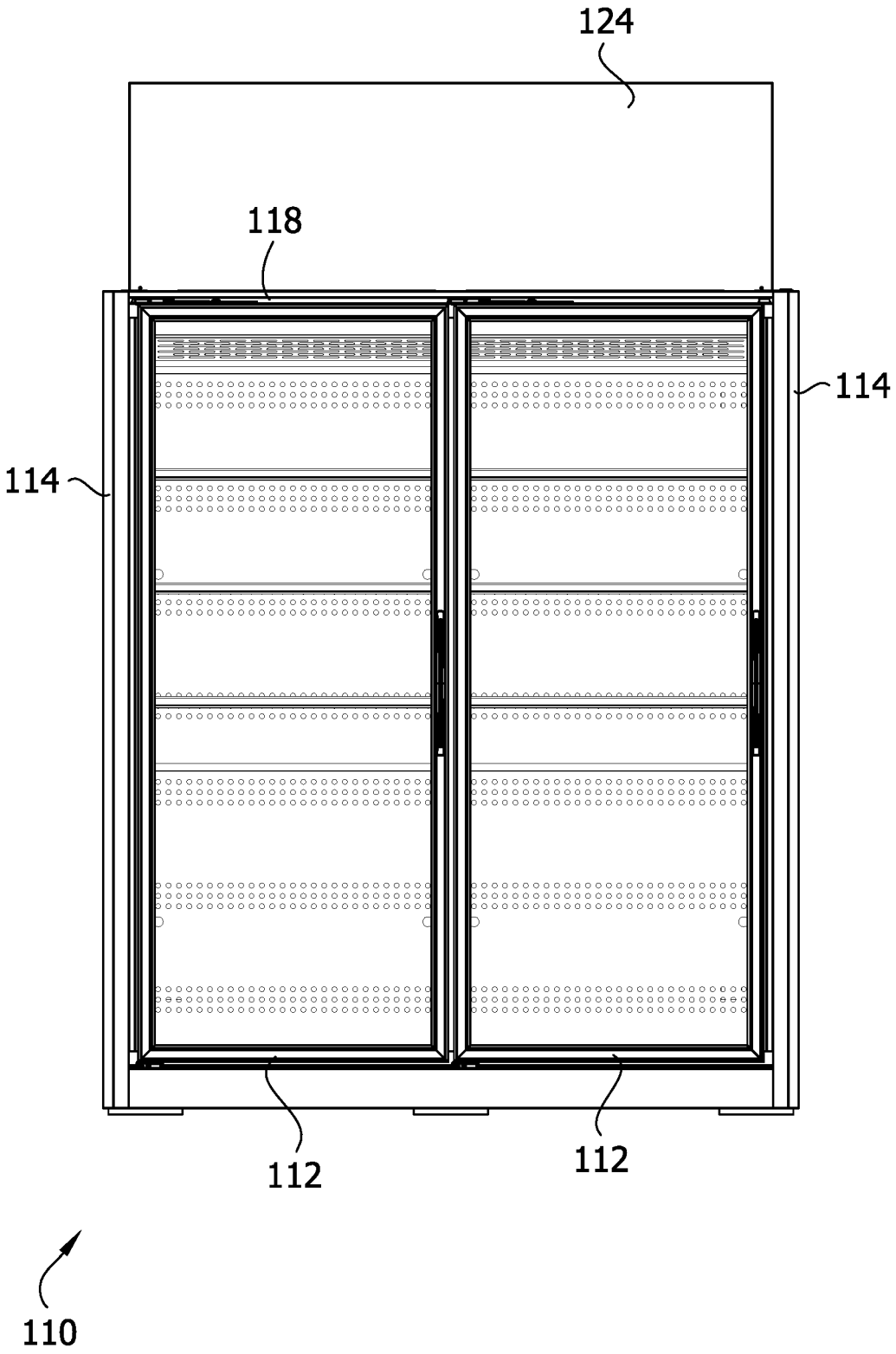
FIG. 3 is a front elevation of the cabinet.

Referring to FIGS. 1-3, one embodiment of a refrigerated cabinet in the scope of this disclosure is generally indicated at reference number 110. In the illustrated embodiment, the refrigerated cabinet 110 comprises a commercial retail merchandiser cabinet. As those skilled in the art will appreciate, retail merchandisers may be equipped with one or more glass doors 112 so that the contents of the cabinet are visible to customers of a retail establishment. It is also contemplated that refrigerated cabinets in the scope of the disclosure may be air curtain-type merchandisers which utilize air curtains in place of doors. Still further, it is contemplated that other types of refrigerated cabinets may be used without departing from the scope of the disclosure. For example, refrigerated cabinets can include upright commercial refrigerators and/or freezers, under-counter refrigerators and/or freezers, open-top refrigerators and/or freezers, drawer refrigerators and/or freezers, or other types of residential or commercial refrigerators and/or freezers. It is contemplated that refrigerated cabinets in the scope of this disclosure may be of the standalone type (where the refrigeration system is incorporated with the cabinet in a single product), of the remote refrigeration type (where the refrigeration system mechanical components are located remote from the refrigeration cabinet and connected to the refrigeration cabinet by ducting, plumbing, and electrical lines), or of another type (e.g., where the cabinet is manufactured separately from the refrigeration system but is configured to have the separate refrigeration unit installed on the cabinet in situ).

The inventors have recognized that refrigeration cabinets of the various types described above can be difficult to install level. The problem is particularly acute in large format merchandiser cabinets, which are very heavy and cumbersome to move. The typical process requires a crew of technicians to load the cabinet onto a jack truck or forklift and then move the cabinet to a deployment position, where the back of the cabinet is typically positioned against a wall or the back of another cabinet. At the deployment position, the cabinet is lowered onto a plurality of stacks of shims, which allow for later height adjustments to level the unit. If the cabinet is being installed in a side-by-side run with additional cabinets, the same process is repeated for the additional cabinets, and then the cabinets are coupled together using mechanical fasteners and sealant. When all of the cabinets are arranged side-by-side, the installer checks the cabinets for levelness. If, as is typical, the cabinets are not initially installed perfectly level, the installer must crawl on the floor and reach under the cabinet to iteratively remove shims from selected shim stacks until the cabinet reaches a level orientation. The inventors have recognized that this process is time consuming and difficult for installers. Because refrigerated cabinets are typically very heavy, it is not easy for installers to load a cabinet onto a jack or accurately lower a cabinet onto a shim stack. Further, the process of removing shims that support the cabinet is challenging, particularly when it is necessary to remove shims from shim stacks positioned near the rear of the cabinet, where access is typically obstructed. Accordingly, the inventors have contemplated an adjustable support system that enables installers to more easily move the heavy cabinet 110 into place and then level the cabinet once it is in position.

Referring to FIGS. 1-3 the cabinet 110 generally comprises a set of walls that separate a refrigerated interior from an exterior of the cabinet. In the illustrated embodiment, the cabinet comprises a pair of side walls 114, a rear wall 116, a top wall 118, and a bottom wall 120. It will be appreciated that, if the cabinet was to be used in a side-by-side configuration with one or more additional refrigerated cabinets, one or both of the side walls could be omitted to provide a contiguous interior along the span of cabinets. It will be appreciated that cabinets with other numbers of doors (e.g., one or more doors) may be used without departing from the scope of the disclosure. In the illustrated embodiment, the cabinet 110 is configured for top-mounted refrigeration. Thus, a refrigeration system (not shown) is mountable on the top wall 118 for cooling the interior of the cabinet 110. An upper shroud 124 is positioned around the perimeter of the top wall 118 above the doors 112 for concealing the refrigeration system. The cabinet 110 has a width extending between the side walls 114 and a depth extending front-to-rear from the doors 112 to the rear wall 116.

The bottom wall 120 of the refrigerated cabinet 110 comprises a foam insulation panel 125 (FIGS. 6-10) extending along the width and depth of the cabinet. In addition, the bottom wall 120 comprises upper and lower skins 126 (e.g., sheet metal skins, FIGS. 6-10) that substantially encapsulate the insulation panel 125. The upper skin 126 defines the upper surface of the bottom wall 120 and the lower skin 126 defines the lower surface of the bottom wall. As shown in FIGS. 5-10, the illustrated bottom wall 120 comprises a plurality of pluggable access openings 128 extending through the wall thickness from the lower surface through the upper surface of the wall such that the access openings open to and are accessible from the interior of the cabinet 110. In particular, the illustrated bottom wall 120 comprises three access openings 128 spaced apart widthwise along the front portion of the bottom wall and three access openings spaced apart widthwise along the rear portion of the bottom wall. It is contemplated that other cabinet bottom walls can have other arrangements of one or more access openings. In certain exemplary embodiments, the bottom wall may comprise at least one access opening at each of the four corner regions of the bottom wall.

Referring to FIG. 1, in the illustrated embodiment, the cabinet 110 comprises three support assemblies 130 coupled to the bottom wall 120 at spaced apart locations along the width of the cabinet between the side walls 114. The three support assemblies 130 form the above-referenced support system of the illustrated cabinet 110. In general, each of the support assemblies 130 is configured to support the cabinet 110 on an underlying support surface (e.g., a floor). Each of the illustrated support assemblies 130 comprises a support bracket 132 that is configured to support one or more fixed, low-friction floor glides 134 and one or more adjustable stabilizing feet 136. In the illustrated embodiment, each of the support assemblies 130 is substantially identical to the others. But in other embodiments, it is contemplated that the support assemblies could differ depending on, for example, their position along the bottom wall.

Figure 4:
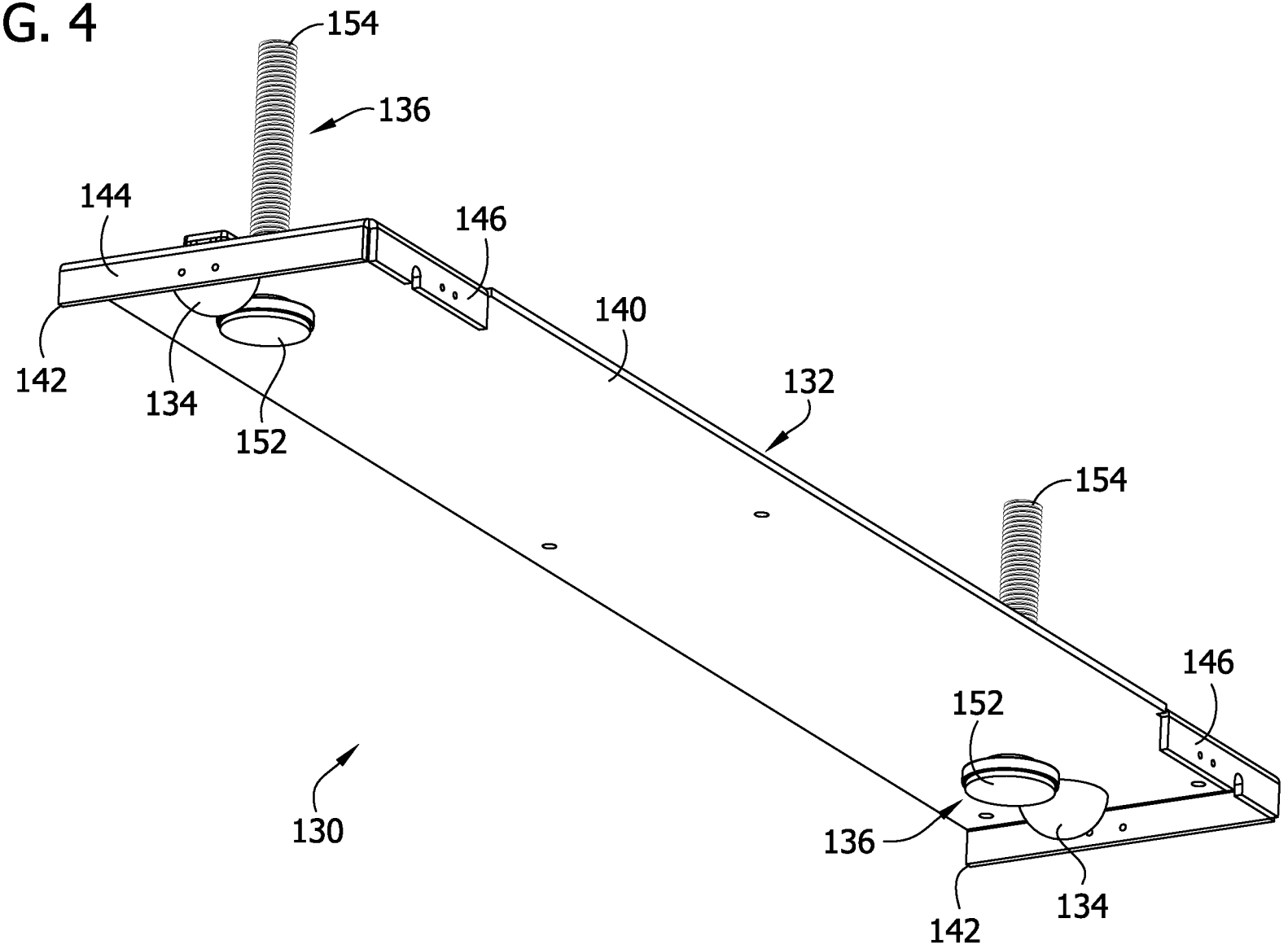
FIG. 4 is a perspective of one support assembly.
Figure 5:
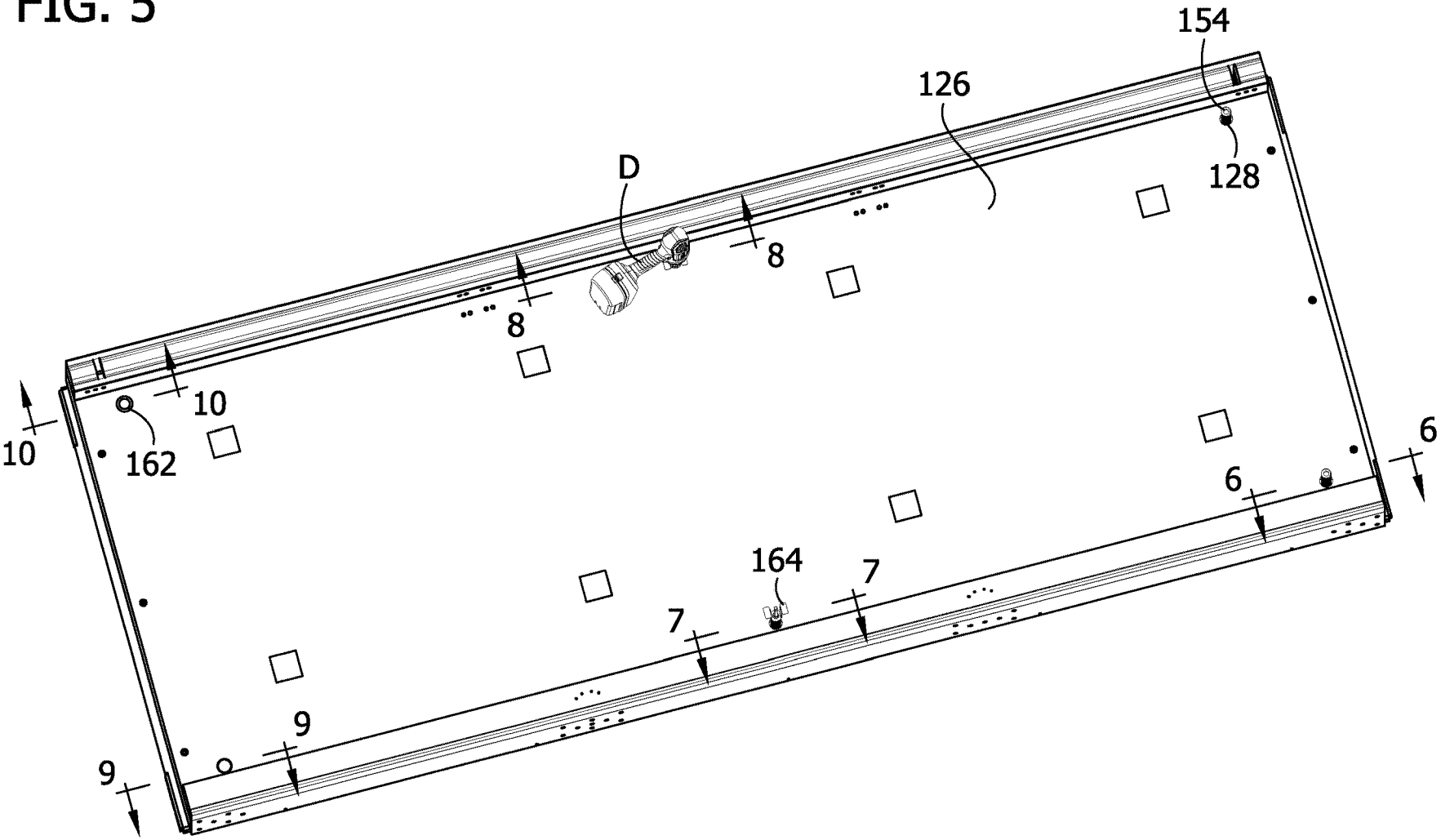
FIG. 5 is a perspective of a bottom assembly of the cabinet including a bottom wall and a plurality of support assemblies, showing feet of the support assemblies in various stages of use.

Referring to FIG. 4, the support bracket 132 comprises a bracket plate that includes an elongate upper web 140 extending longitudinally from a front end portion to a rear end portion. The support bracket 132 is installed on the lower surface of the bottom wall 120 so that the elongate web 140 extends generally front-to-rear with the front end portion underlying the front portion of the bottom wall and the rear end portion underlying the rear portion of the bottom wall. The illustrated support bracket 132 further comprises front and rear flanges 142 that extend downward from the front and rear end portions of the upper web 140 along the front and rear end portions thereof. The front flange 142 includes a front edge portion 144 that forms a toe kick attachment fixture defining toe kick attachment points (e.g., fastener holes such as screw or bolt holes) for attaching a toe kick 122 (FIG. 2) to the remainder of the cabinet 110. In certain embodiments, the attachment points can be defined by clip-on nuts that are secured to the front edge portion 144. Each of the flanges 142 further comprises a side edge portion 146 that forms a cabinet-to-cabinet attachment fixture that defines attachment points (e.g., faster holes such as screw or bolt holes) for attaching the refrigerated cabinet 110 to an adjacent cabinet. Thus, it will be appreciated that the support assemblies 130 installed along the side portions of the cabinet should be installed so that the side edge portions 146 of the flanges 142 face laterally outward.

Figure 6:
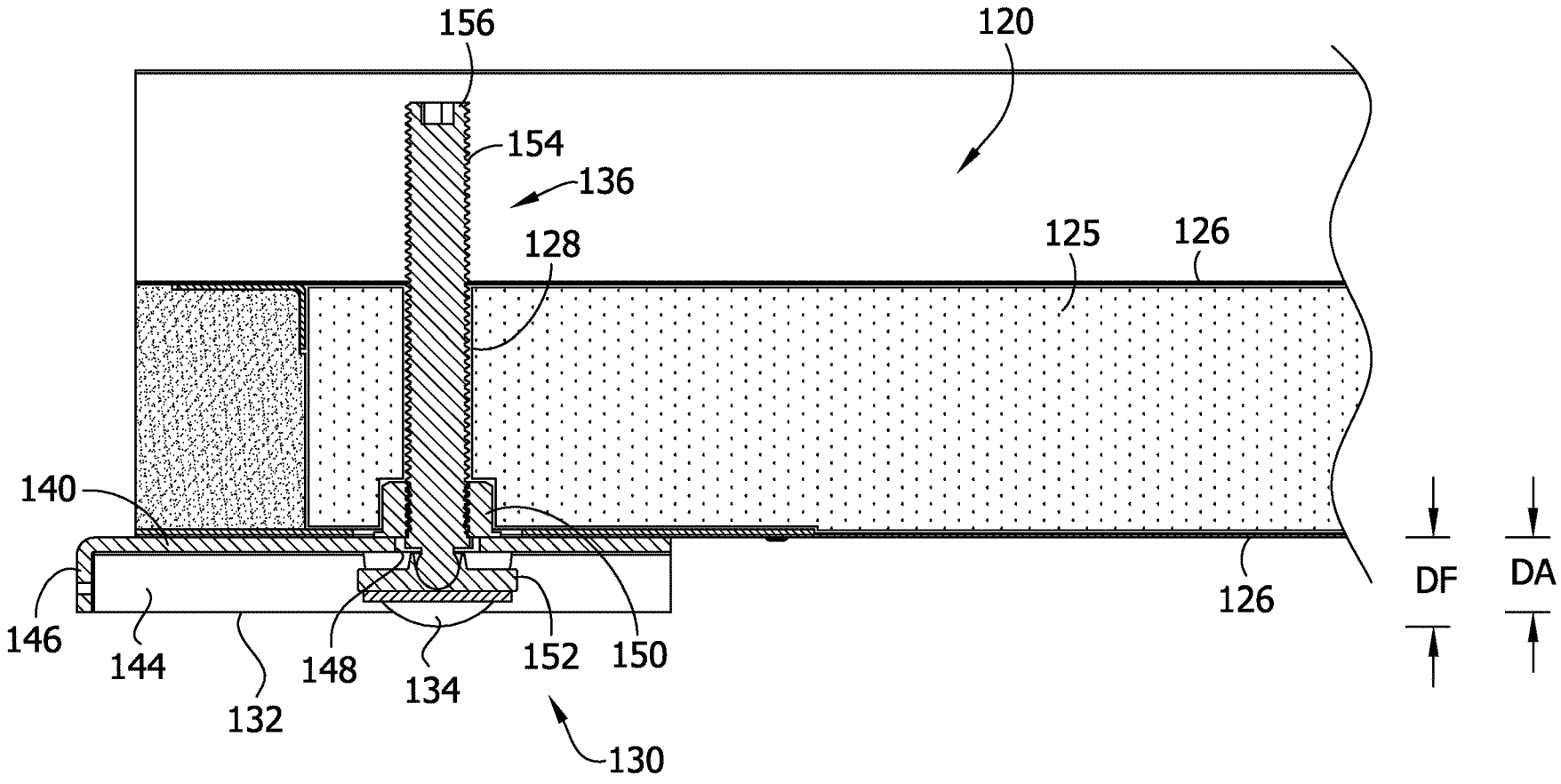
FIG. 6 is a cross-section taken through the plane of line 6-6 of FIG. 5, showing a foot of a support assembly in an upper position.
Figure 7:
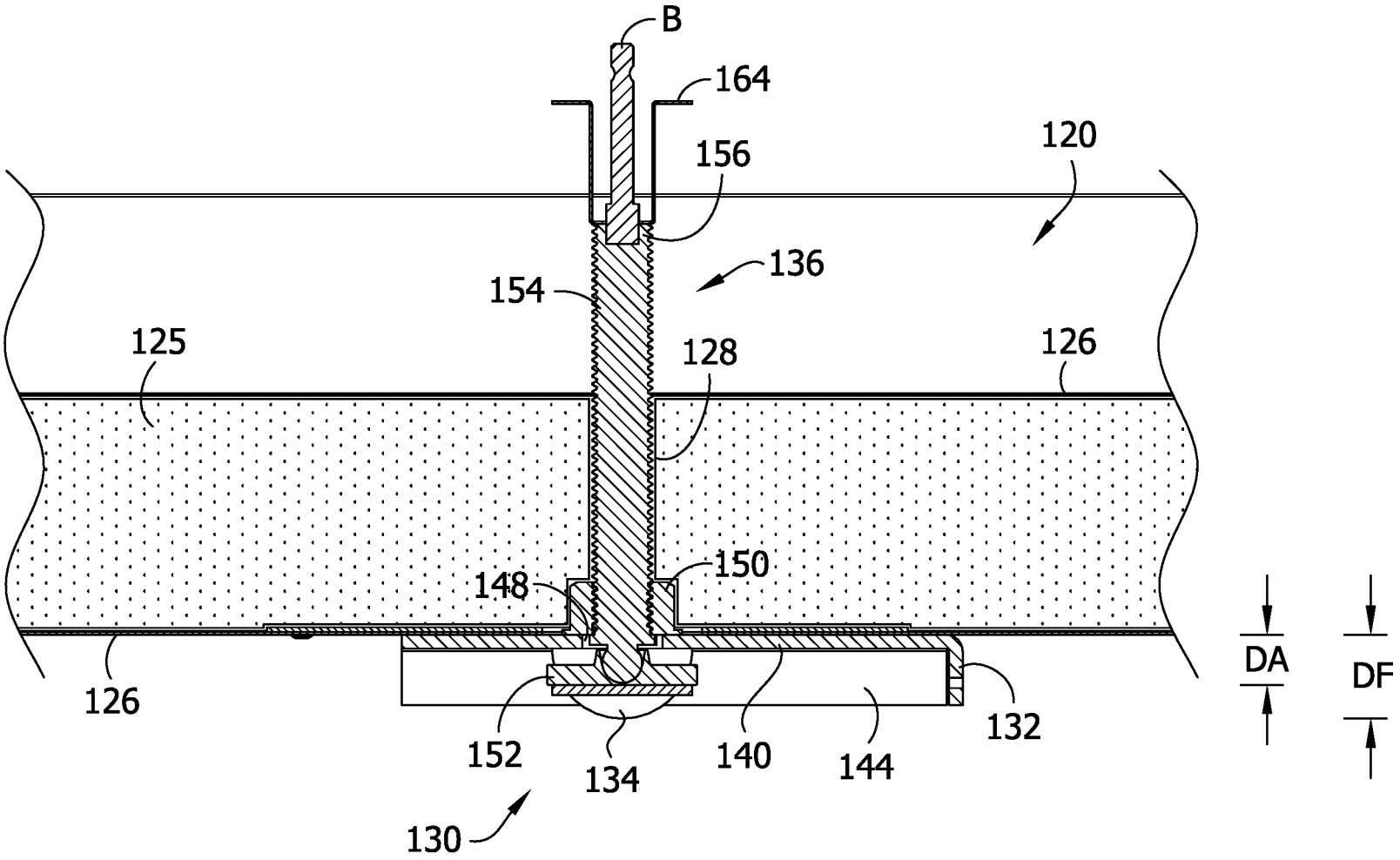
FIG. 7 is a cross-section taken through the plane of line 7-7 of FIG. 5, showing a center range gauge and a drill bit engaged with a foot of a support assembly in an upper position.
Figure 8:
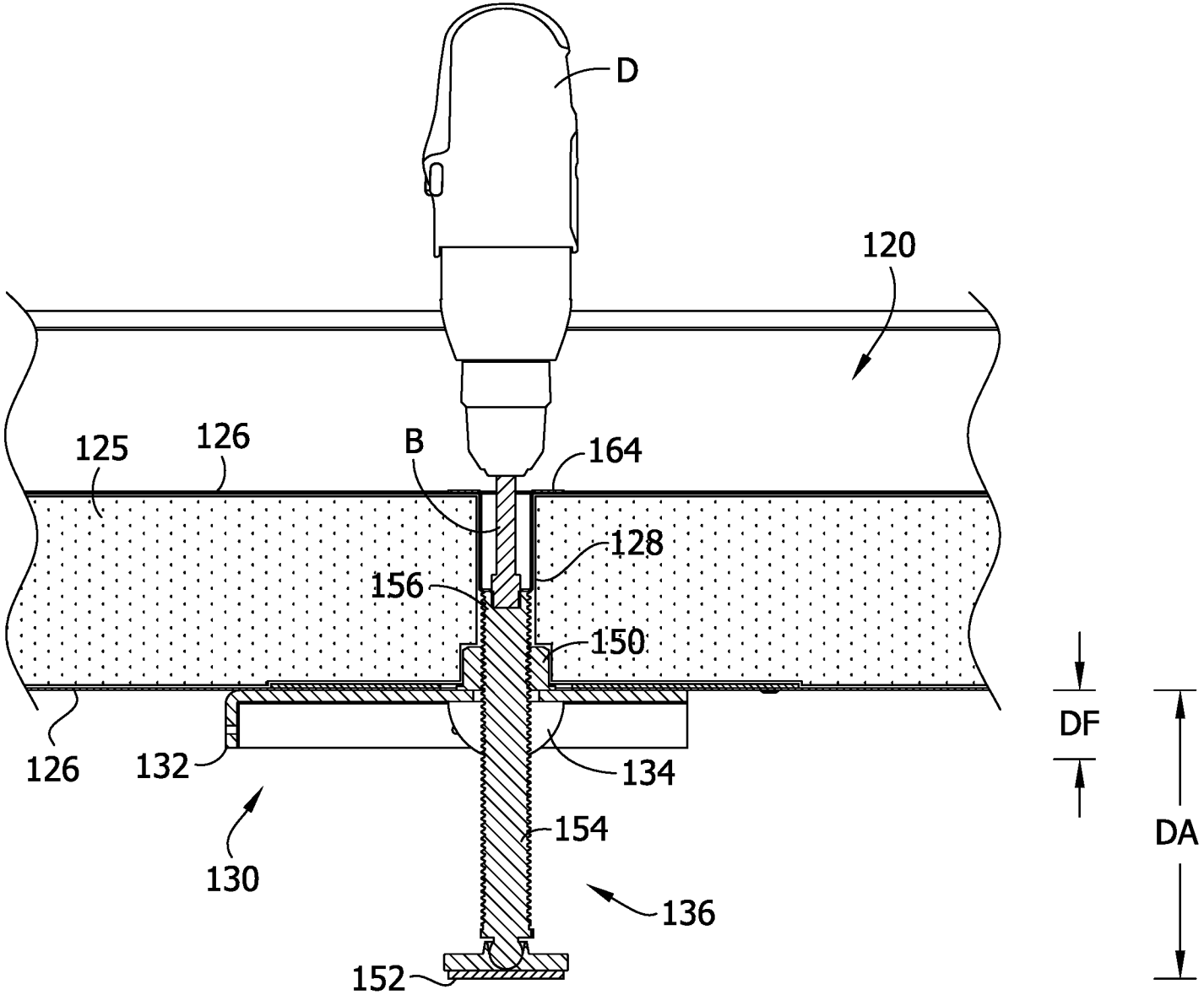
FIG. 8 is a cross-section taken through the plane of line 8-8 of FIG. 5, showing a drill engaged with another foot of the support assembly of FIG. 7, wherein the foot is at a lower position and a center range gauge is received at an indicating position in an access opening of the bottom wall.

Referring to FIGS. 4 and 6, in an exemplary embodiment, one floor glide 134 is attached to the bottom of the upper web 140 at a location adjacent the front end portion of the bracket 132 and another floor glide 134 is attached to the bottom of the upper web at a location adjacent the rear end portion of the bracket. As shown in FIGS. 6-8, the floor glide 134 can be mounted on the support bracket 120 to protrude downward from the bottom wall 120 by a vertical distance DF. In one or more embodiments, the distance DF can be a fixed distance. In other words, the floor glide 134 can be fixedly mounted on the support plate 130. As will be explained in further detail below, the feet 136, by contrast, are vertically adjustable in relation to the support bracket 132 to adjust the orientation of the cabinet 110 on the support surface (e.g., to level the cabinet). In exemplary embodiments, the floor glides 134 have lower contact surfaces formed from relatively low-friction material. For example, in one or more embodiments the floor glides are formed from one or more of polyoxymethylene, polyethylene, polypropylene, polyamide, polycarbonate, and nylon. In the illustrated embodiment, each of the floor glides 134 has an inverted dome shape or semispherical shape pointing downward. Other shapes, including flat-bottom shapes, are also possible within the scope of the disclosure.

Referring to FIGS. 6-7, the upper web 140 of the support bracket 132 comprises a front and rear foot openings 148 adjacent the front and rear end portions of the support bracket. The bracket 132 further comprises a nut 150 affixed (e.g., welded) to the upper web 150 at each foot opening 148 to define a respective threaded opening of the bracket. It is also contemplated that a threaded opening may be tapped directly into a bracket plate in one or more alternative embodiments. As will be explained in further detail below, each nut 150 is configured to threadably connect to one of the feet 136 so that the foot is vertically adjustable with respect to the bottom wall 120. Each nut 150 is received in a lower portion of a respective one of the access openings 128 (e.g., the threaded opening is in registration with the access opening) so that a portion of the respective foot 136 can extend through the nut and the access opening.

Referring to FIGS. 4-10, in general, each support assembly 130 comprises at least one adjustable foot 136 that is connected to the bottom wall 120 for supporting the bottom wall and the remainder of the cabinet 110 on a support surface. As explained more fully below, each foot 136 is movable relative to the bottom wall 120 to adjust a vertical position of the foot with respect to the bottom wall. In other words, the foot 136 is movable along a vertical axis to adjust an adjustable distance DA between the bottom wall 120 and an underlying support surface. By adjusting the adjustable distance DA of one or more of a plurality of feet 136 connected to the bottom wall 120 at spaced apart locations along the depth and width of the cabinet 110, an installer can level the cabinet. As will be explained more fully below, an installer can adjust the illustrated feet 136 working inside the cabinet, eliminating the need for crawling on the floor and reaching under the cabinet during the leveling process. In the illustrated embodiment, each foot 136 has a range of motion relative to the bottom wall 120 along a vertical axis. The complete range of motion extends from an uppermost position shown in FIGS. 6-7, at which a bottom of the foot is spaced apart above a bottom of the floor glide 134, to a lowermost position somewhat lower to the positions shown in FIGS. 8-10, and at which the bottom of the foot is spaced apart below the bottom of the floor glide.

In the illustrated embodiment, each foot 136 comprises a contact portion 152 and a threaded shaft 154 extending upward from the contact portion along a vertical axis. In general, the contact portions 152 of one or more of the feet 136 comprise a bottom surface formed from material having a greater static coefficient of friction than the floor glides 134. As such, when the feet 136 are lowered to lift the cabinet off of the floor glides 134, the cabinet 110 is stably supported on the feet. In one or more embodiments, the contact portion 152 of one or more of the feet 136 can comprise a contact pad defining the bottom surface and formed from an elastomer such as styrene-butadiene rubber. In certain embodiments, the contact portions 152 of a subset of the feet include elastomeric contact pads while the bottom surfaces of the remaining feet are formed from a metal contact part. It is believed, that including a metal contact part on at least some of the feet 136 enables greater control of fine height adjustments when leveling a cabinet 110 or connecting the cabinet end-to-end with additional cabinets. In exemplary arrangement, four feet positioned at corner regions of the cabinet bottom wall include metal contact and one or more feet at central locations along the bottom wall include elastomeric contact pads.

The threaded shaft 154 of each foot 136 is configured to be threadably received in a respective one of the nuts 150. Because each nut 150 is received in a respective access opening 128 and the access opening opens to the interior of the cabinet 110, the foot 136—in particular the upper end portion or head 156 of the threaded shaft 154—is accessible through the access opening from within the interior of the cabinet. As will now be appreciated, this enables an installer to adjust the distance DA between the bottom wall 120 and the support surface on which the cabinet 110 rests from within the interior of the cabinet. The threaded shaft 154 is received in the nut 150 such that the distance DA can be adjusted by rotating the shaft 154 relative to the support bracket 132. In the illustrated embodiment, the head 156 of the shaft 154 includes a driver bit recess (e.g., a Phillips recess, a slotted recess, a torx recess, a spline recess, a hexagonal recess, etc.) configured to connect the threaded shaft to a drill bit B (FIG. 7, broadly a tool head) or other driver for rotation therewith. Thus, an installer can use a drill D (FIGS. 5, 8) or driver (e.g., a socket wrench) within the interior of the cabinet 110 to adjust the vertical distance DA that each foot 136 extends downward from the bottom wall 120, enabling the installer to perform all of the required leveling adjustments from within the cabinet interior.

FIGS. 6-7 depict a foot 136 of the cabinet 110 in an exemplary initial position. Here, "initial position" broadly refers to a position of the foot 136 immediately before a cabinet is slid along a support surface to or from a deployment position. "Deployment position" refers to a position of the entire cabinet 110 at which the cabinet is deployed for refrigeration, for example, against the wall of a retail store. As shown in FIGS. 6-7, in the initial position, the bottom of each foot 136 is spaced apart above the bottom of the adjacent floor glide 134. In other words, the fixed distance DF by which the bottom of the glide 134 is spaced apart from the bottom of the wall 120 is greater than the adjustable distance DA by which the bottom of the foot 136 is spaced from the bottom of the wall. As such, when the feet 136 are in the initial (upper) positions, the cabinet 110 is supported on the floor glides 134. As can be seen, this enables the cabinet 110 to be moved with relative ease along a floor to a deployment position, without requiring any lifting/moving equipment such as a pallet jack or a forklift. Thus, in one or more embodiments, the cabinet 110 ships from a factory or distribution warehouse with each of the feet 136 in the initial (upper) position shown in FIG. 6. After the cabinet 110 is slid on the protruding glides 134 across the floor to a deployment position, the feet 136 are lowered to the positions shown in FIGS. 8-10.

Figure 9:
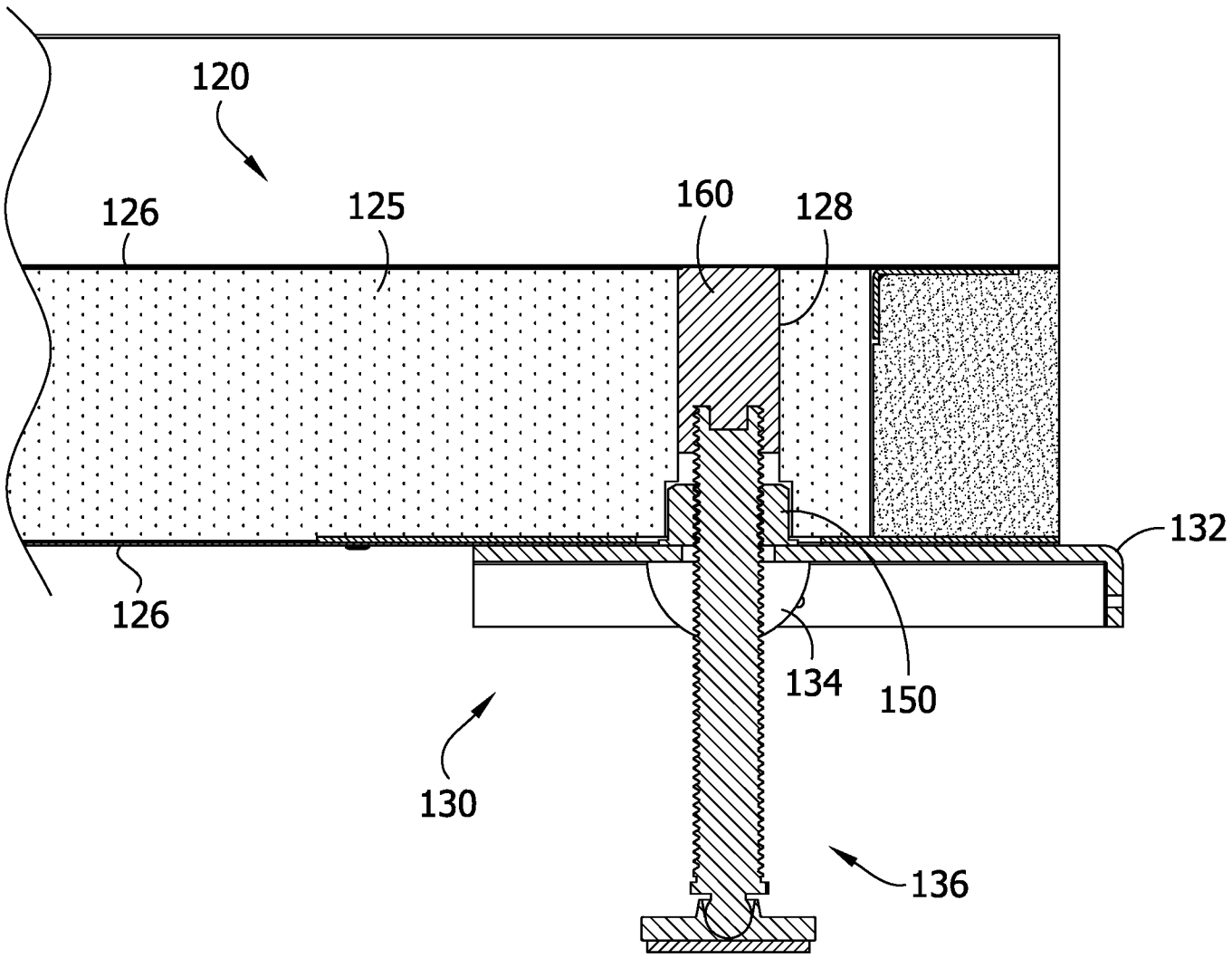
FIG. 9 is a cross-section taken through the plane of line 9-9 of FIG. 5, showing a foot of a support assembly in a lower position and an insulating plug in a corresponding access opening.
Figure 10:
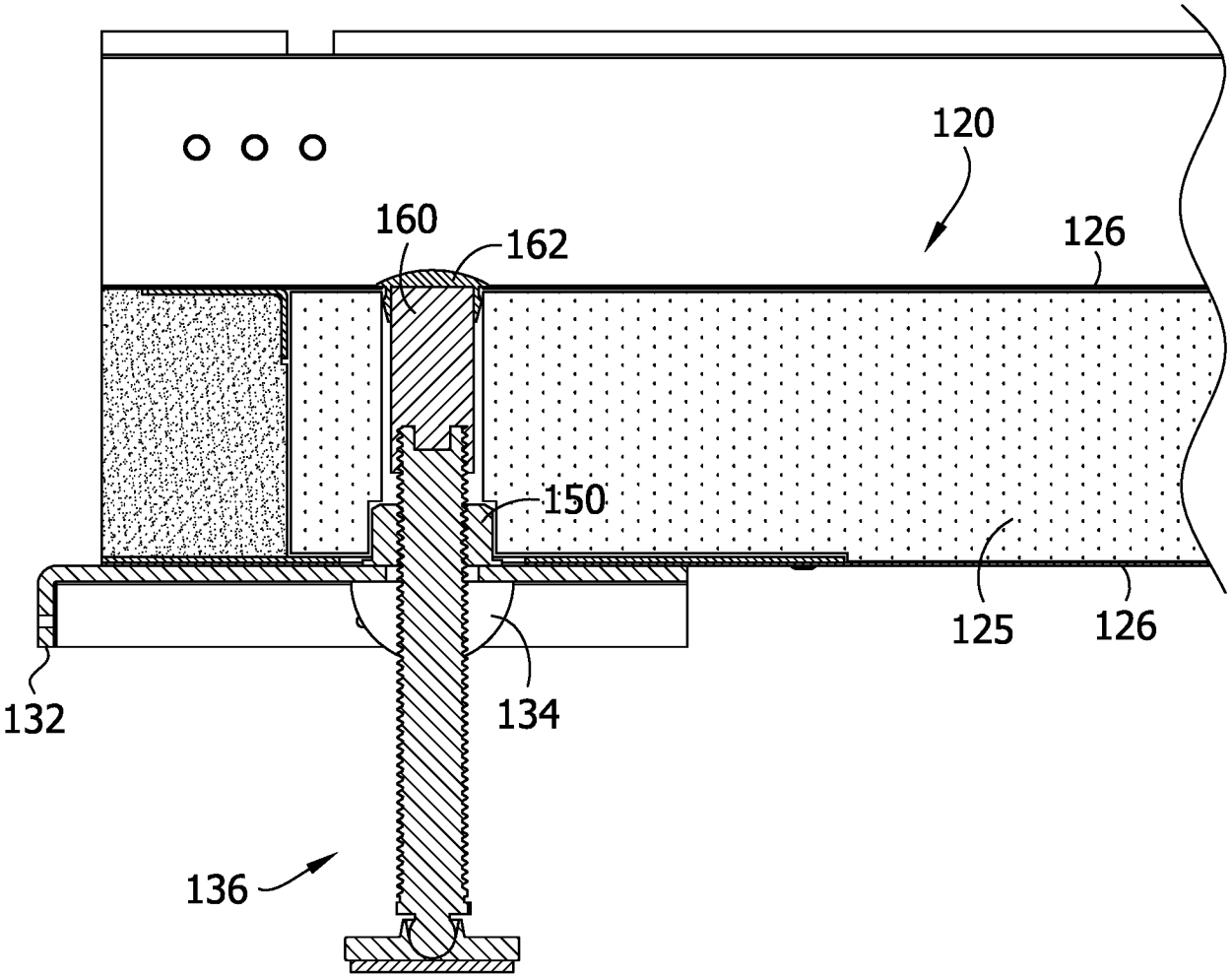
FIG. 10 is a cross-section taken through the plane of line 10-10 of FIG. 5, showing another foot of the support assembly of FIG. 9 in a lower position, an insulating plug in a corresponding access opening, and a cap over the insulating plug.

Referring now to FIGS. 8-10, in one or more embodiments, each of the feet 136 is configured to be lowered to a final cabinet-supporting position at which the head 156 is recessed below the top of the corresponding access opening 128. The purpose of recessing the heads 156 in this manner is so that a portion of the opening 128 extending through the insulation panel 125 can be filled with an insulating plug 160, as shown in FIGS. 9-10. Each insulating plug 160 is formed from a material with good thermal insulation properties. As such, when each of the feet 136 is lowered and each of the openings 128 is filled with a respective plug 160, the bottom wall 120 provides a substantially contiguous layer of insulation along the bottom of the cabinet interior. In one or more embodiments, the plugs may be covered with removable caps 162 suitably matched in appearance and/or material to the upper skin 126.

In order to provide sufficient clearance for the plugs 160, in one or more embodiments, before making final leveling adjustments, each of the feet 136 is lowered to a "center range position" that is substantially vertically centered along a lower portion of the total range of motion that can accommodate the entire plug 160, e.g., along the entire lower portion of the range of motion, the plug can be received in the access opening above the head 156. This allows small leveling adjustments to subsequently be made to any of the feet 136 (e.g., movement up or down from the center range position), while ensuring that feet remain within the lower portion of the range of motion to accommodate the plug 160. To ensure that the cabinet 110 is installed level with each of the feet positioned within this lower portion of the range of motion, as shown in FIGS. 5, 7, 8, and 12, the illustrated cabinet includes a center range gauge 164 that indicates the location of the head 156 at a center position within the lower portion of the range of motion. In particular, the center range gauge 164 comprises a lower annular wall 166 configured to be received over the upper end portion of the threaded shaft 154, a pair of arms 168 extending upward from the perimeter edge margin of the lower annular wall on diametrically opposite sides, and flanges 170 extending radially outward from the upper end portions of the arms 168. In use, the lower annular wall 166 is positioned on the head 156 of the threaded shaft 154 as shown in FIG. 7. The spaced arms 168 and the opening through the annular wall 166 allow a bit B or other tool to head engage the shaft head 156. The bit B is then used to rotate the threaded shaft 154 and thereby lower the foot 136 until the upper flanges 170 engage the upper surface of the bottom wall 120, as shown in FIG. 8. The engagement of the upper flanges 170 with the upper surface of the bottom wall 120 provides an indication that the foot 136 is located generally at the desired center range location. In one or more embodiments, after the cabinet 110 is slid on the floor glides 134 to a deployment position, the center range gauge 164 is used to position each of the feet 126 at the respective center range location before making fine adjustments to the feet to level the cabinet 110. This ensures that, when the cabinet is finally leveled, each of the feet 136 is positioned low enough on the bottom wall 120 so that the plug 160 can fit within the access opening 128.

Figure 11:
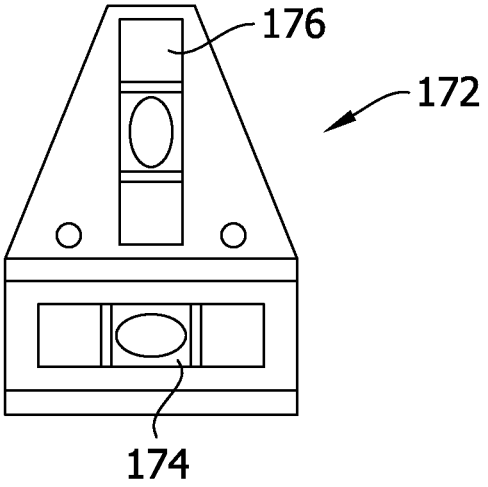
FIG. 11 is a front elevation of a level indicator.
Figure 12:
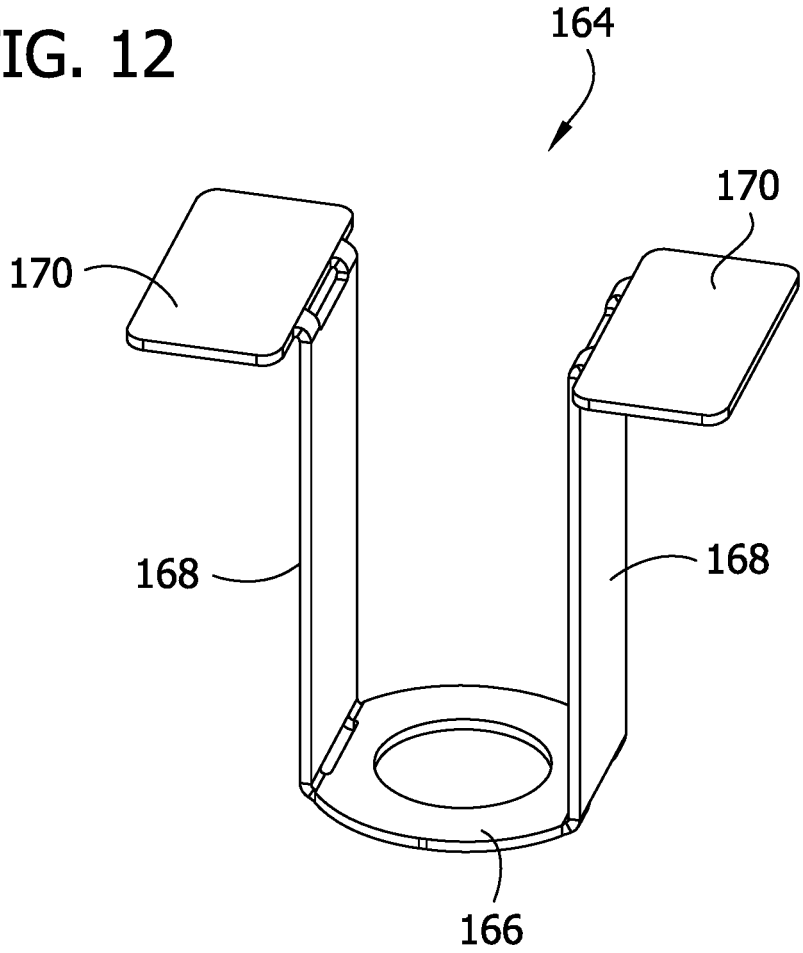
FIG. 12 is a perspective of a center range gauge.
Figure 13:
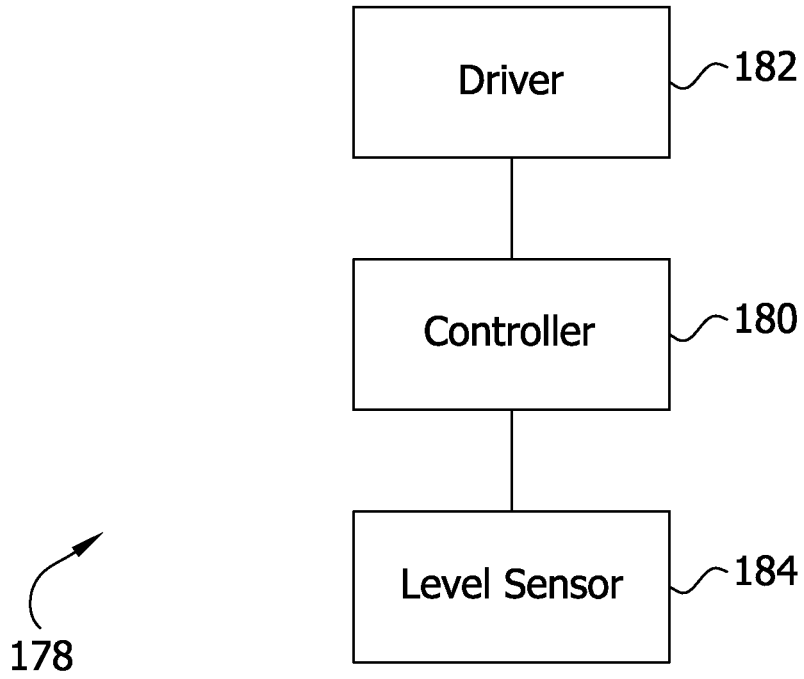
FIG. 13 is a schematic block diagram of an automated leveling system of a refrigerated cabinet.

Referring to FIG. 11, in one or more embodiments, the cabinet includes a level indicator 172. In the illustrated embodiment, the level indicator 172 comprises a spirit or bubble level. More particularly, the illustrated indicator 172 comprises a tubular horizontal spirit level 174 and a tubular vertical spirit level 176. It is contemplated that, in another embodiment, the level will comprise a bullseye level. Suitably, the level indicator 172 is mounted on the interior surface of at least one of the walls 114, 116 adjacent one of the access openings 128. In certain embodiments, multiple level indicators 172 are mounted on the walls 114, 116 adjacent respective access openings 128. In some embodiments, a first level indicator 172 may be mounted on the rear wall 116 for indicating levelness in the widthwise direction and a second level indicator may be mounted on one of the side walls 114 for indicating levelness in the front-to-back direction. Providing one or more integrated level indicators 172 enables the technician to make a verification of levelness while making adjustments to the vertical positions of one or more of the feet 136 from within the interior of the cabinet 110. In certain embodiments the level indicator 172 may not be affixed to the cabinet 110. For example, the cabinet 110 may include a manual or decal that provides instructions on where to place the level during the leveling process.

An exemplary method of deploying the cabinet 110 will now be briefly described. The cabinet 110 is initially shipped from the manufacturer or distributor with the feet 136 in the initial positions shown in FIG. 6. In other words, each of the floor glides 134 protrude downward from the bottom wall 120 by a distance DF and each of the feet 136 protrude downward from the bottom wall by a distance DA that is less than the distance DF. Thus, the cabinet 110 is supported on the floor glides 134. In this configuration, the cabinet 110 can slide on the floor glides 134 with relative ease to move the cabinet to the deployment position (e.g., a location against the wall).

Once the cabinet 110 is positioned at the desired deployment position, the installers can support the cabinet on its feet 136. Initially, the installers use the center range gauge 164 to lower each foot 136 to a center range position, as shown in FIGS. 7 and 8. More specifically, the installers place the gauge 164 on the head 156 of each threaded shaft 154 inside the interior of the cabinet 110 and then use a drill D or other driver inside the cabinet to rotate the shaft until the flanges 170 engage the upper surface of the bottom wall 120, indicating the foot 136 is at the desired center range position. Subsequently, the installer users a drill D or other driver to make fine adjustments to the vertical positions of selected feet 136 until the cabinet is level in both the widthwise and front-to-rear directions. More particularly, the installer engages a tool head B to the head 156 of the threaded shaft 154 of selected ones of the feet 136 within the interior of the cabinet 110 and rotates the tool head to rotate the foot 136 relative to the bottom wall 120 and thereby adjust the vertical position as desired. In certain embodiments, the installers utilize integrated level indicators 172 to determine that the cabinet 110 is roughly level. Optionally, the installer may then place a long level (e.g., a box beam level) along a reference surface of the cabinet 110 to ensure that the cabinet is substantially level widthwise and front-to-rear. Additional adjustments may be made to the feet 136 from inside the cabinet 110 to further improve levelness as required. Once the cabinet is leveled to satisfaction, as shown in FIGS. 9 and 10, the installer inserts plugs 160 into each of the access openings 128 and installs caps 162 over the plugs.

One potential advantage of the illustrated cabinet 110 is for use in a setting that may require periodic redeployment of the cabinet at different locations. The cabinet 110 can be moved by removing the caps 162 and plugs 160, rotating the threaded shafts 154 of the feet 136 to raise the feet so that the cabinet is again supported on the glides 134, and then sliding the cabinet on the glides to the desired redeployment location. Once the cabinet 110 reaches the redeployment location, the feet 136 can be lowered and used to stabilize and level the cabinet in the same manner described above.

It is contemplated, that in one or more embodiments, the cabinet 110 may be provided with an automated leveling system 178. Thus, in one or more embodiments, the cabinet 110 comprises a level controller 180, one or more foot drivers 182, and a level sensor 184. The level sensor 184 may be integrated into the cabinet or may be a separate instrument configured to plug into the controller 180 of the cabinet via a communication port. Each foot driver 182 may comprise an electric motor coupled to a gear train configured to drive rotation of the threaded shaft 154 of a respective one of the feet. The level sensor 184 suitably comprises one or more inclinometers or other sensor configured to provide an output signal representative of an orientation of one or more axes of a plane of the cabinet 110 intended to be horizontal when deployed. The controller 180 is connected to the level sensor 184 to receive the orientation signal. In response to the orientation signal, the controller is configured to send control signals to the foot drivers 182 that actuate the drivers 182 to raise and lower the feet as needed to level the plane of the cabinet.

It is also contemplated that a controller 180 and an electronic level sensor 184 can be used with a manually adjusted foot 136. For example, in one or more embodiments, the controller 180 is connected to an indicator (e.g., a display, a light element, an audio device, etc.). The controller can interpret the signal from the level sensor 184 and actuate the indicator to provide indications to the installer of the levelness of the cabinet.

Referring now to FIGS. 14-18, the inventors have recognized that there is a risk that an installer, working from within the cabinet to adjust the feet, could, by mistake, lower a foot beyond the lowest position at which it remains securely connected to the cabinet 110. This presents a serious safety risk. If one of the feet were to become disconnected, the cabinet 110 could tip or fall onto the installer. As explained above, there are many advantages to the illustrated adjustment system enabling the installer to adjust the feet from inside the cabinet 110. But the installer does not have a clear line of site to the point of connection between the foot and the support bracket. Hence, the inventors believe that providing an additional restraint against over-rotating the foot can make the installation process safer for the installer.

In order to address this safety risk, the inventors have designed a new foot 136' that includes a stop 137' broadly configured to limit downward adjustment of the foot with respect to the bottom wall of the cabinet 110. The foot 136' is substantially similar to the foot 136, except for features pertaining to the stop 137'. Features of the foot 136' corresponding to the foot 136 will be given the same reference number, followed by a prime symbol. The foot 136' may replace the foot 136 in the cabinet 110 and throughout this disclosure.

Figure 16:
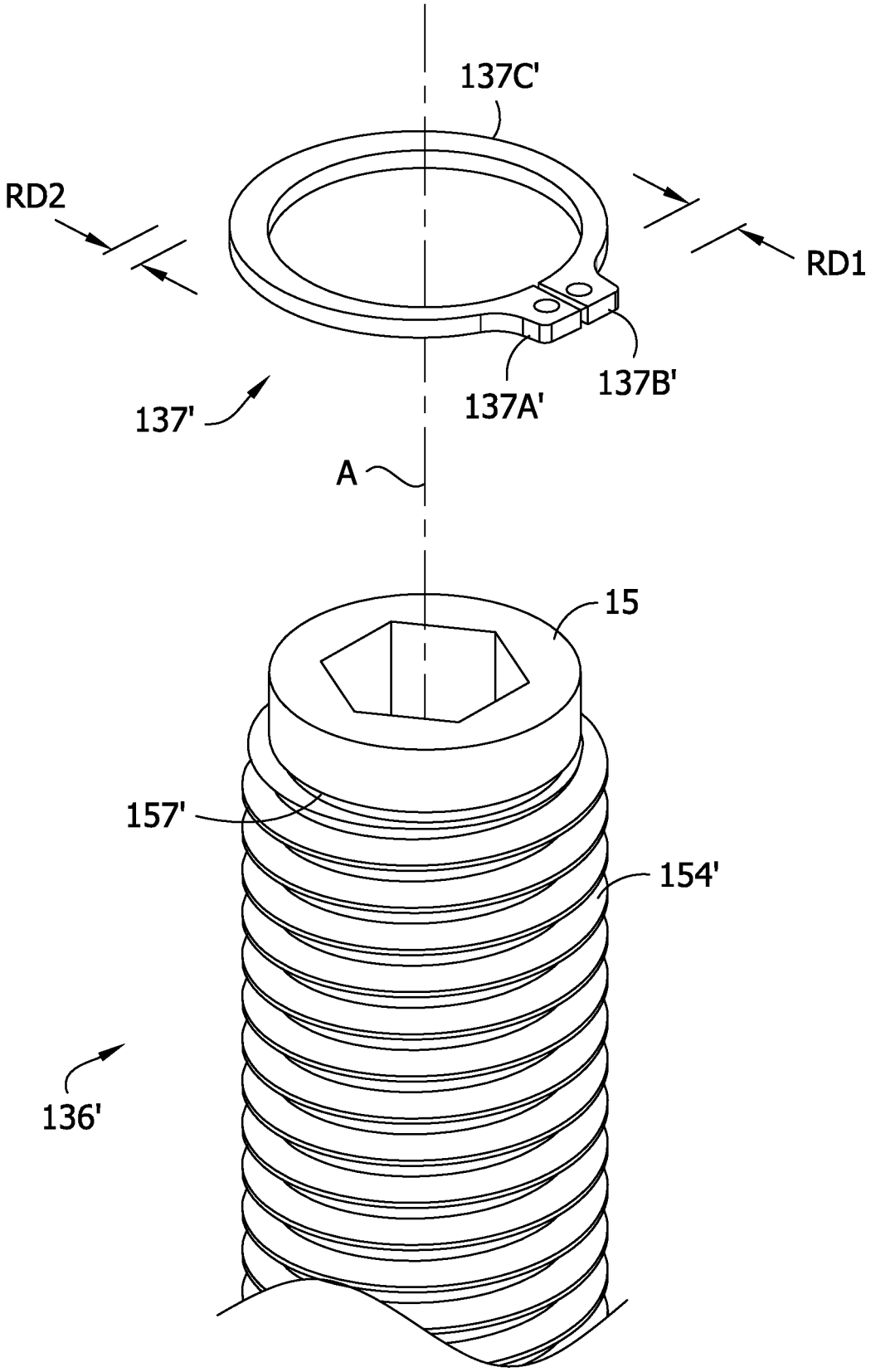
FIG. 16 is an enlarged fragmentary exploded perspective of the foot of FIG. 14.

The foot 136' comprises a threaded shaft 154' having an upper end portion 156' and a lower end portion spaced apart along an axis A of the threaded shaft. The stop 137' broadly comprises a projection extending radially outward with respect to the axis A at the upper end portion 156' of the threaded shaft 154'. More particularly, in the illustrated embodiment, the upper end portion 156' of the threaded shaft 154' comprises a peripheral annular groove 157' (FIG. 16) and the stop 137' comprises a retaining ring received in the peripheral annular groove. As shown in FIG. 16, the retaining ring 137' comprises an external shaft ring having a first end portion 137A', a second end portion 137B', and a length extending from the first end portion to the second end portion. The length of the retaining ring 137' extends in a loop about the axis A of the threaded shaft 154' such that the first end portion 137A' is located adjacent to the second end portion 137B' and is spaced apart from the second end portion by slit in the retaining ring. The first end portion 137A' and the second end portion 137B' of the retaining ring 137' each have a first radial dimension RD1 with respect to the axis A of the threaded shaft 154'. The retaining ring 137' further comprises a segment 137C' between the first end portion 137A' and the second end portion 137B', which segment (137C') extends along a majority of the length of the retaining ring. This middle segment 137C' has a second radial dimension RD2. The first radial dimension RD1 is greater than the second radial dimension RD2 such that at least the first and second end portions 137A', 137B' form the radial protrusion that provides the stop limiting downward movement of the foot 136'. In certain embodiments, the radial dimension RD2 of the middles segment 137C' is sized so that the entire middle segment also protrudes radially from the shaft 154' to form a radial protrusion that provides a stop limiting downward movement of the foot 136'

Figure 14:
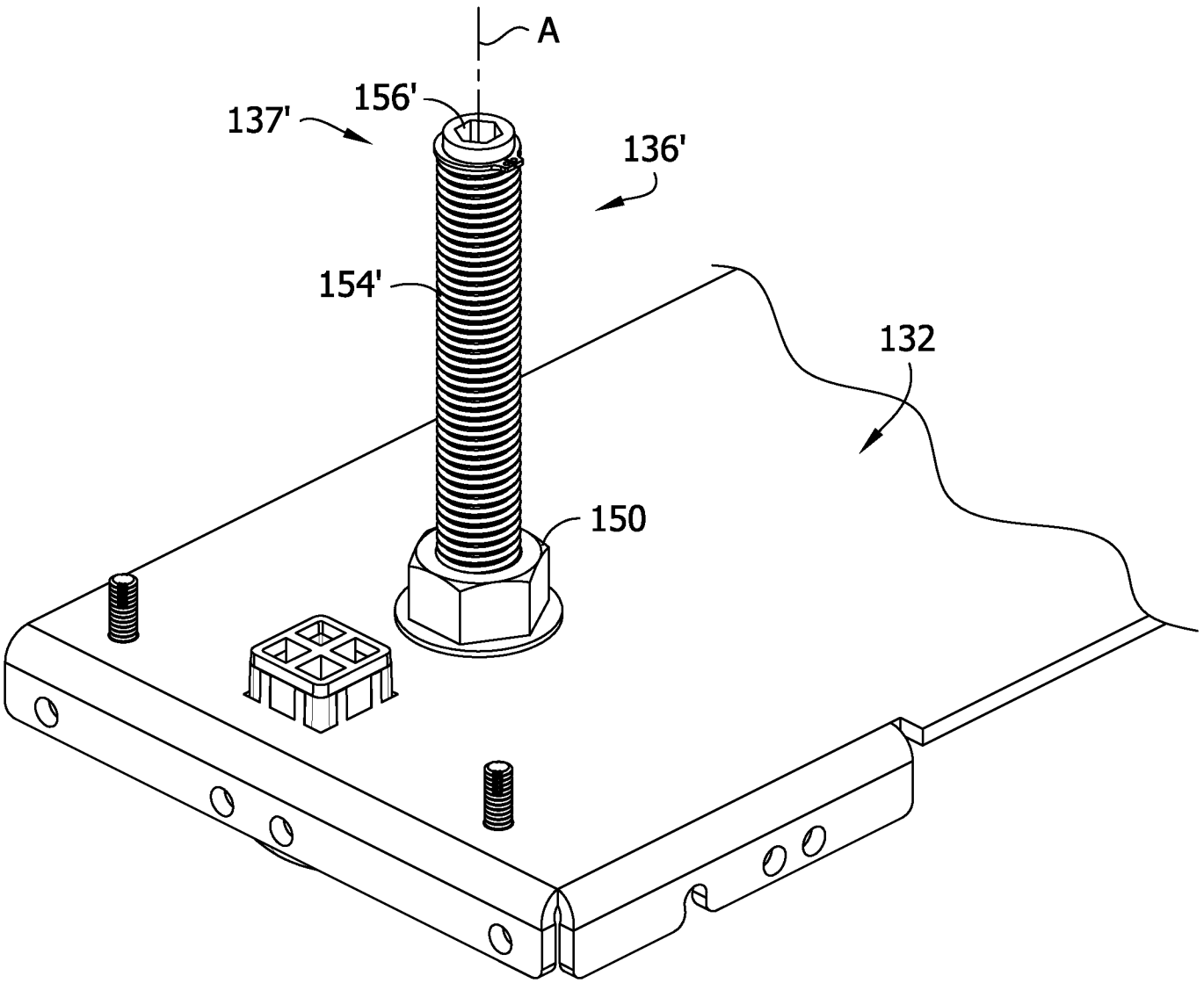
FIG. 14 is an enlarged fragmentary perspective of a portion of a support bracket including a foot having a stop on an upper end portion of a threaded shaft.
Figure 15:
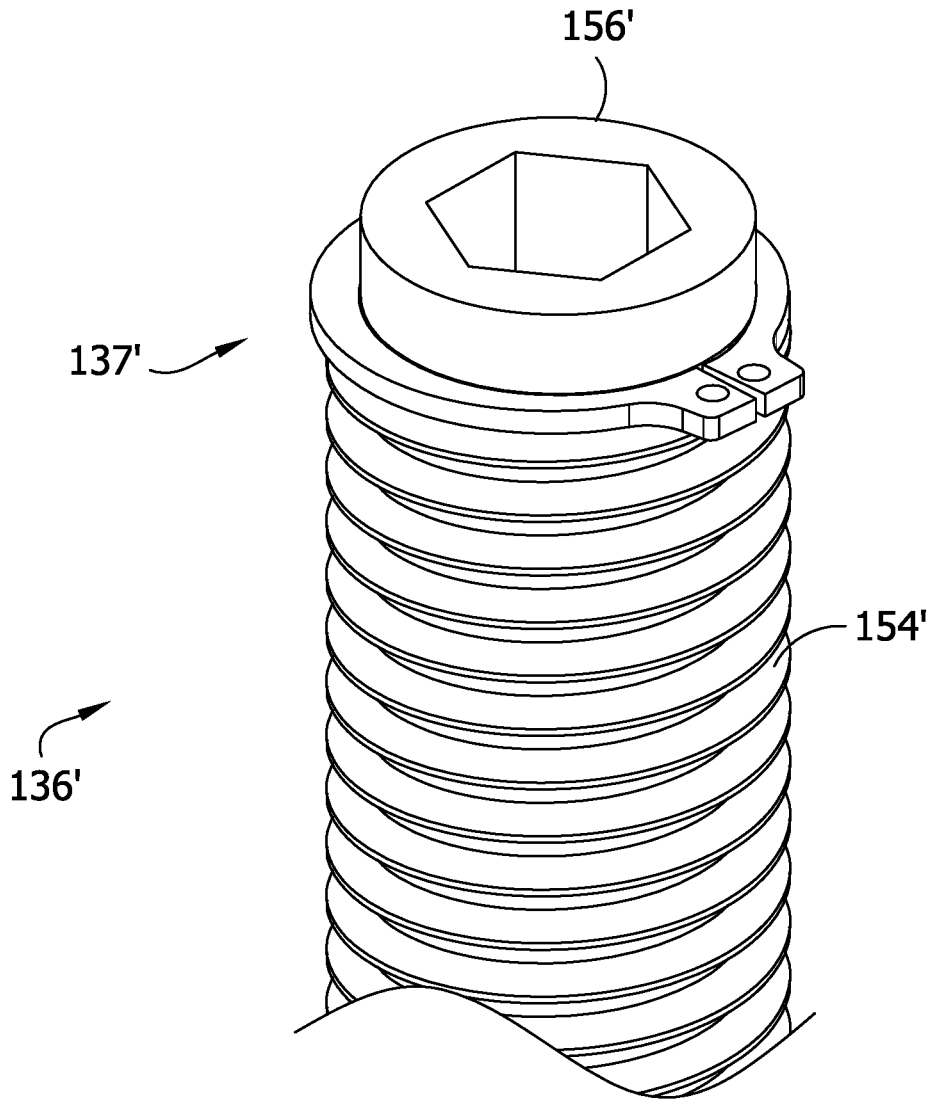
FIG. 15 is an enlarged view of the upper end portion of the shaft of FIG. 14.
Figure 17:
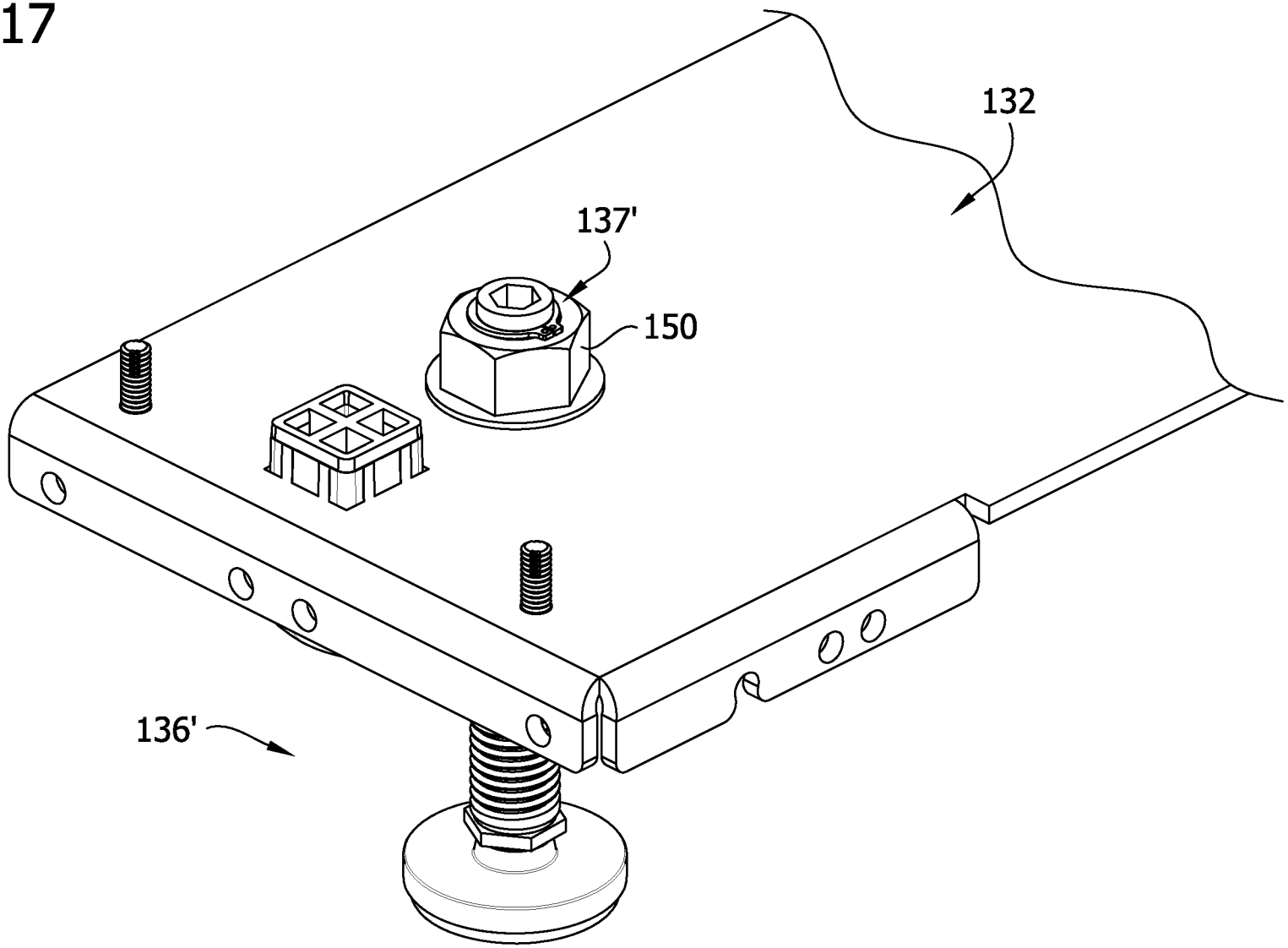
FIG. 17 is an enlarged fragmentary perspective similar to FIG. 14 but showing the foot at a bottom positioning of its range of motion where the stop limits downward movement of the foot.
Figure 18:
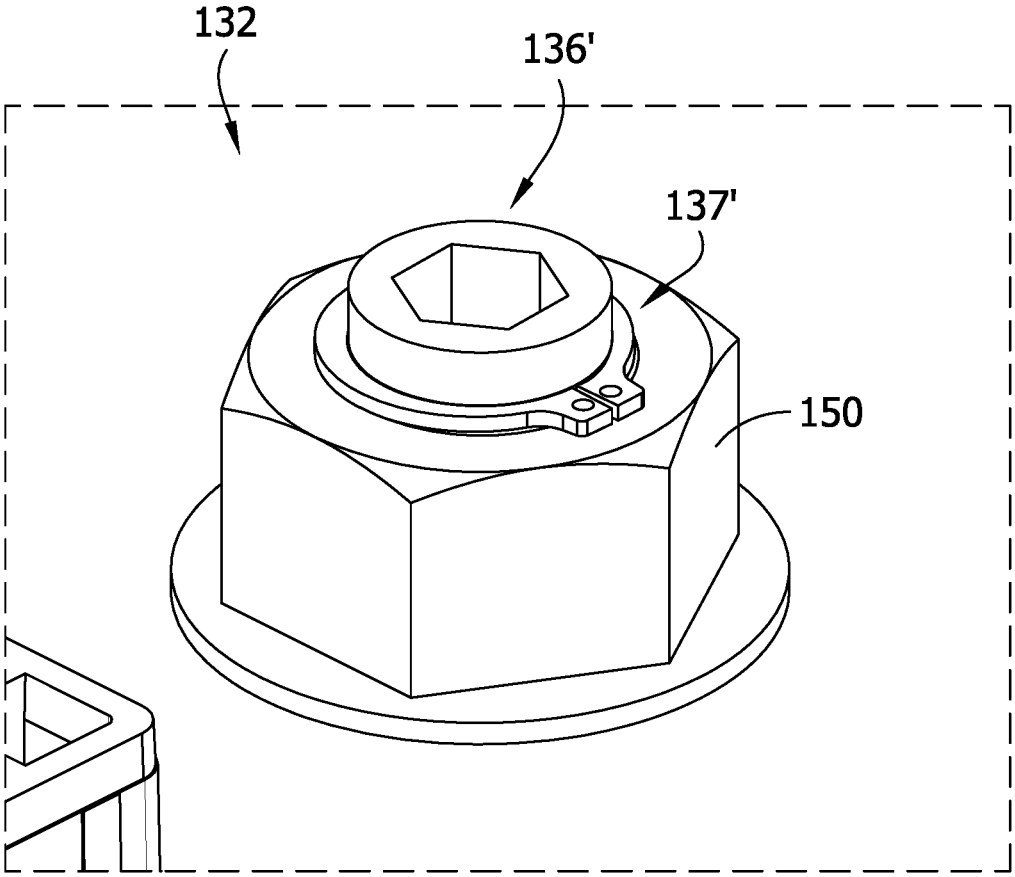
FIG. 18 is an enlarged view of a portion of FIG. 17.

As shown in FIGS. 14, 17, and 18, the threaded shaft 154' of each foot 136' is threadably received in one of the nuts 150 of the support brackets 132. In an exemplary embodiment, a foot 136' with safety stop 137' is received in each nut 150 of the cabinet 110. As explained above, the threaded shafts 154' can be used to lift the cabinet 110 off of the glides 134 onto the feet 136' and can be further adjusted to level the cabinet 110. During these processes, the threaded shaft 154' is configured to be threadably advanced downward by rotation with respect to the nut 150. If the installer would accidentally over-rotate the foot 136', the stop 137' is configured to engage the top of nut 150 to limit downward adjustment of the foot with respect to the bottom wall 120 of the cabinet 110. In other words, the stop 137' defines a bottom position of a vertical adjustment range of the foot 136' and will not allow the foot the be moved downward past this bottom position.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

What is claimed is:

1. A refrigeration cabinet, the cabinet comprising:

walls separating an exterior of the cabinet from an interior of the cabinet that is configured to be refrigerated by a refrigeration system connected to the cabinet, the walls including a bottom wall;

a foot connected to the bottom wall for supporting the bottom wall on a support surface, the foot being selectively movable relative to the bottom wall to adjust a vertical position of the foot with respect to the bottom wall;

wherein the bottom wall is configured such that the foot is accessible from within the interior of the cabinet to allow a user to selectively move the foot to adjust the vertical position of the foot with respect to the bottom wall; and wherein the foot includes a stop configured to limit downward adjustment of the foot with respect to the bottom wall of the cabinet;

wherein the foot comprises a threaded shaft having an upper end portion and a lower end portion spaced apart along an axis of the threaded shaft;

wherein the stop comprises a projection extending radially outward with respect to the axis at the upper end portion of the threaded shaft;

wherein the refrigerator cabinet further comprises a support bracket connected to the bottom wall, wherein the foot is coupled to the support bracket;

wherein the support bracket comprises a threaded opening and the threaded shaft is threadably received in the threaded opening such that the vertical position of the foot is adjustable by rotating the foot relative to the support bracket;

wherein the support bracket comprises a bracket plate and a nut affixed to the bracket plate, the nut defining at least a portion of the threaded opening;

wherein the threaded shaft is configured to be threadably advanced downward by rotation with respect to the nut and wherein the stop is configured to engage the threaded nut to limit downward adjustment of the foot with respect to the bottom wall.

2. The refrigerated cabinet as set forth in claim 1, wherein the upper end portion of the threaded shaft comprises a peripheral annular groove.

3. The refrigerated cabinet as set forth in claim 2, wherein the stop comprises a retaining ring received in the peripheral annular groove.

4. The refrigerated cabinet as set forth in claim 3, wherein the retaining ring comprises an external shaft ring having a first end portion, a second end portion, and a length extending from the first end portion to the second end portion, the length of the external shaft ring extending in a loop about the axis of the threaded shaft such that the first end portion is located adjacent to the second end portion and is spaced apart from the second end portion by slit in the retaining ring.

5. The refrigerated cabinet as set forth in claim 4, wherein the first end portion and the second end portion of the retaining ring each having a radial dimension with respect to the axis of the threaded shaft that is greater than a radial dimension of a segment of the length of the external shaft ring spaced apart between the first end portion and the second end portion and which segment extends a majority of the length of the retaining ring.

6. The refrigerated cabinet as set forth in claim 1, wherein the support bracket comprises a flange configured to at least one of (i) attach a kick plate to the cabinet and (ii) attach the cabinet in side-by-side relation with another cabinet.

7. The refrigerated cabinet as set forth in claim 1, wherein the support bracket comprises a front threaded opening and a rear threaded opening.

8. The refrigerated cabinet as set forth in claim 1, wherein the bottom wall comprises a foam panel and the threaded shaft extending through the foam panel.

9. The refrigerated cabinet as set forth in claim 8, wherein the bottom wall comprises an access opening extending through the foam panel.

10. The refrigerated cabinet as set forth in claim 9, further comprising an insulating plug configured to be inserted into the access opening.

11. The refrigerated cabinet as set forth in claim 1, wherein bottom wall has first, second, third, and fourth corner regions;

wherein the foot comprises a first foot located at the first corner region, a second foot located at the second corner region, a third foot located at the third corner region, a fourth foot located at the fourth corner region.

12. A refrigeration cabinet, the cabinet comprising:

walls separating an exterior of the cabinet from an interior of the cabinet that is configured to be refrigerated by a refrigeration system connected to the cabinet, the walls including a bottom wall;

a foot connected to the bottom wall for supporting the bottom wall on a support surface, the foot being selectively movable relative to the bottom wall to adjust a vertical position of the foot with respect to the bottom wall;

wherein the bottom wall is configured such that the foot is accessible from within the interior of the cabinet to allow a user to selectively move the foot to adjust the vertical position of the foot with respect to the bottom wall; and wherein the foot includes a stop configured to limit downward adjustment of the foot with respect to the bottom wall of the cabinet;

wherein bottom wall has first, second, third, and fourth corner regions;

wherein the foot comprises a first foot located at the first corner region, a second foot located at the second corner region, a third foot located at the third corner region, a fourth foot located at the fourth corner region;

wherein each of the first foot, the second foot, the third foot, and the fourth foot is partially received in a respective access opening extending through a thickness of the bottom wall, wherein the cabinet further comprises a center range gauge configured to be positioned in each of the access openings to provide an indication of a center range position of the respective one of the first foot, the second foot, the third foot, and the fourth foot.

13. The cabinet as set forth in claim 1, further comprising a floor glide on the bottom wall of the cabinet and spaced apart from the foot, wherein the foot is movable relative to the bracket to an upper position at which a bottom of the foot is above a bottom of the floor glide to a lower position at which the bottom of the foot is below the bottom of the floor glide.

14. The cabinet as set forth in claim 13, wherein the floor glide is configured to enable the cabinet to slide along a support surface to a deployment position and the foot is configured to be lowered after the cabinet is at the deployment position to support the cabinet at the deployment position on the foot.

* * * * *